United States Patent [19]

Itoh et al.

[11] 4,030,533

[45] June 21, 1977

[54] CONTINUOUS CASTING SYSTEM

[75] Inventors: Yasuo Itoh; Yoshitake Suzuki, both of Kisarazu; Hirohiko Shibutami, Kitakyushu; Koichi Hirano, Kitakyushu; Muneo Tagami, Kitakyushu, all of Japan

[73] Assignees: Nippon Steel Corporation, Tokyo; Kabushiki Kaisha Yaskawa Denki Seisakusho, both of Japan

[22] Filed: May 14, 1976

[21] Appl. No.: 686,362

Related U.S. Application Data

[62] Division of Ser. No. 588,698, June 20, 1975, Pat. No. 3,987,841.

[30] Foreign Application Priority Data

June 24, 1974 Japan ..... 49-71394

[52] U.S. Cl. ..... 164/147; 164/154; 164/260; 164/282

[51] Int. Cl.[2] ..... B22D 11/10; B22D 11/16

[58] Field of Search ..... 164/82, 147, 154, 250, 164/260, 269, 282

[56] References Cited

UNITED STATES PATENTS

| | | | |
|---|---|---|---|
| 2,743,492 | 5/1956 | Easton | 164/147 |
| 2,944,309 | 7/1960 | Schaaber | 164/147 |
| 3,153,820 | 10/1964 | Criner | 164/250 UX |
| 3,656,537 | 4/1972 | VonStorck | 164/282 X |

FOREIGN PATENTS OR APPLICATIONS

| | | | |
|---|---|---|---|
| 46-13511 | 11/1968 | Japan | 164/282 |

*Primary Examiner*—Ronald J. Shore
*Attorney, Agent, or Firm*—Fitzpatrick, Cella, Harper & Scinto

[57] ABSTRACT

A continuous casting system provides with a foreign matter receiving gutter between two adjacent rolls to receive foreign matters dropping during the drawing operation of castings, and a foreign matter removing nozzle to wash away the foreign matter dropped on the gutter. An electromagnetic agitator of the continuous casting system is provided with a proximity switch at least at its inlet side to sense a magnetic substance approaching the agitator thereby to control the operation of the agitator, thus eliminating troubles caused by the vibration of the magnetic substance.

4 Claims, 5 Drawing Figures

CONTINUOUS CASTING SYSTEM

This is a division of application Ser. No. 588,698 filed June 20, 1975, now U.S. Pat. No. 3,987,841.

BACKGROUND OF THE INVENTION

This invention relates to continuous casting systems and more particularly to the removal of foreign matters, such as asbestos and waste materials produced in manufacturing castings, accumulated between casting rolls of the continuous casting system, and to countermeasures against various troubles caused by magnetic substances included in the foreign matters.

In a continuous casting system for casting metal such as for instance steel, a number of rolls are arranged in the direction of drawing castings and the distances between these rolls are very short, and yet a large number of casting cooling spray pipes are provided close to one another between the rolls thus arranged.

In manufacturing castings by the continuous casting system thus organized, frequently considerable segregation occurs and pores and prismatic crystals are produced in the castings. In order to solve these difficulties, a technique of electromagnetically agitating the molten metal left in a casting for its certain length measured from the mold has been proposed. In this method, an electromagnetic agitator is positioned between predetermined rolls.

When in the continuous casting system described above, a casting is drawn out of the mold, asbestos, shavings on a dummy bar and other waste materials created in cooling the casting are dropped and accumulated under the rolls in the vicinity of the electromagnetic agitator, and in addition scales peeled off the casting are dropped; that is, a large quantity of foreign matters is deposited under the rolls near the electromagnetic agitation during the drawing operation of casting. This is one of the difficulties accompanying the conventional continuous casting system.

More specifically, the foreign matters thus dropped and accumulated often cause casting cooling nozzles to be clogged up although the casting cooling process plays an important part in manufacturing castings, that is, they effect the casting drawing speed and a casting quality. Furthermore, these foreign matters cause the rolls to irregularly rotate or stop at worst, as a result of which the rolls are worn at only one side thereby reducing their service lives, and the surface of a casting is scratched.

Therefore, in the case when such foreign matters are deposited between the rolls, it is necessary to suspend the operation of the casting system so that a person can go in the narrow space between the rollers to remove the foreign matters. However, the environmental conditions of the continuous casting system are, in general, hazardous when viewed in the light of safety. More specifically, the temperature in a room where the continuous casting system is operated is very high, and the electromagnetic agitator is provided with its electric system in the vicinity of the rollers and therefore the hazard of electric leak may be encountered in the removal of the foreign matter. Accordingly, it is impossible to smoothly and quickly achieve the removal of foreign matters. This is a waste of time in the drawing operation of casting.

In the case where the foreign matters are magnetic substances, the magnetic substance in the magnetic field of the electromagnetic agitator induces a force of vibration whose frequency is twice the frequency of the power supply of the agitator. This force is much greater than the force of an induction current contributing to agitating the molten metal in a casting, and breaks the rolls. As a result, the shell of the casting is damaged, and at worst the casting is broken.

With the continuous casting system, there are a number of chances for magnetic substances to have an adverse influence on the operation thereof. Briefly, these chances occur in the following three cases (1), (2) and (3).

Case (1) where a so-called "dummy bar" including magnetic substances is employed when a pouring operation starts.

Case (2) where a drawing speed is excessively reduced while steel is poured into the mold or where the steel pouring operation is temporarily suspended, as a result of which the surface temperature of a casting in the electromagnetic agitator is lowered below the Curie temperature.

Case (3) where the scales of a steel material drop to the electromagnetic agitator while it is being poured into the mold, or where magnetic ground metals are caused to drop to the agitator by the leakage of molten metal.

In case (1), the force of vibration described above is certainly produced. Cases (2) and (3) are abnormal conditions in manufacturing castings and in these cases the force of vibration is not always induced, however there are cases in which magnetic substances approach the electromagnetic agitator. Therefore, in all of the cases (1), (2) and (3), some countermeasure must be taken so that no force of vibration is caused by magnetic substances.

In case (1), the operator observing the movement of the dummy bar turns off the electromagnetic agitator before it reaches the agitator and turns on the agitator later when the dummy bar has moved out of the magnetic field thereof. In case (2), after the operator has detected that the drawing speed is extremely reduced or the pouring operation is suspended, he controls the operation of the agitator in the same manner as in case (1). In case (3) also, the operation of the agitator is controlled by the operator after he has detected the production of the vibration. Accordingly, the timing of turning on and off the electromagnetic agitator is liable to be unsuitable. This is an obstruction to the effective, smooth operation of the continuous casting system which has been highly improved in processing speed and in processing capacity.

SUMMARY OF THE INVENTION

Accordingly, it is an object of this invention to provide a continuous casting system in which all of the above-described difficulties accompanying conventional continuous casting systems have been solved.

More specifically, an object of the invention is to provide a continuous casting system which can remove foreign matters such as asbestos and scales dropped during a casting drawing operation, thereby to prevent its rolls from being irregularly rotated and accordingly irregularly worn, and resultantly to increase the service lives of the rolls.

Another object of the invention is to provide a continuous casting system which can detect a magnetic substance approaching its electromagnetic agitator thereby to prevent a casting from being vibrated by the magnetic substance.

The manner in which the foregoing objects and other objects are achieved by this invention will become more apparent from the following detailed description and the appended claims when read in conjunction with the accompanying drawings, in which like parts are designated by like reference numerals.

Briefly summarized, according to one aspect of this invention, provided is a continuous casting system which comprises a foreign matter receiving gutter provided between two adjacent rolls for receiving foreign matters dropping during the drawing operation of castings, and a foreign matter removing nozzle provided at least at one end of the foreign matter receiving gutter, the foreign matter removing nozzle being directed to foreign matters dropped on the gutter to wash away the foreign matters with pressurized water.

According to another aspect of the invention, a continuous casting system is provided with a magnetic substance detector, such as a proximity switch, positioned at least at the inlet side of an electromagnetic agitator, the detector detecting a magnetic substance approaching the electromagnetic agitator thereby to control the operation of the electromagnetic agitator.

DETAILED DESCRIPTION OF THE INVENTION

Figure 1:
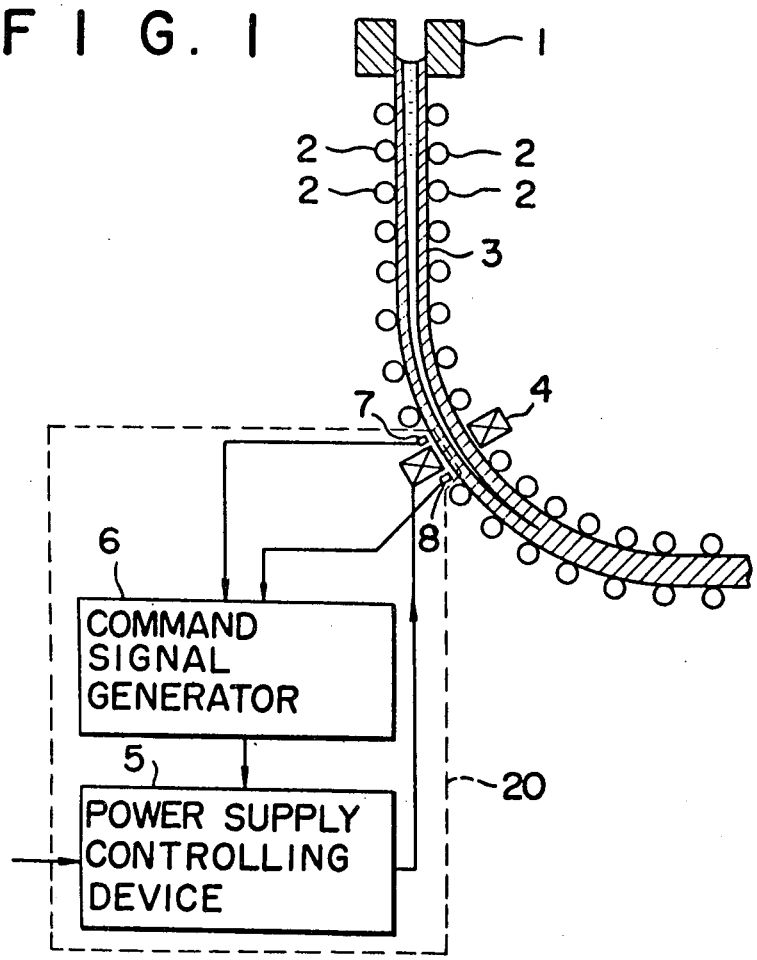
FIG. 1 is an explanatory diagram, partly as a block diagram, illustrating one embodiment of a continuous casting system according to this invention.

One preferred embodiment of this invention is shown in FIG. 1, which comprises a mold 1 from which a casting 3 is drawn, rolls 2 provided on both sides of the passage of castings, an electromagnetic agitator 4 provided at an appropriate point of the passage, and an electromagnetic agitaator control means 20. This control means 20 comprises magnetic substance detecting means 7 and 8 such as proximity switches provided respectively on the inlet and outlet sides of the electromagnetic agitator for detecting a magnetic substance, a command signal generator 6 for generating command signals in response to the operation of the proximity switches 7 and 8, and an electric power supply cntrolling device 5 for controlling the supply of electric power to the electromagnetic agitator 4 by receiving the command signal from the command signal generator 6.

Figure 3:
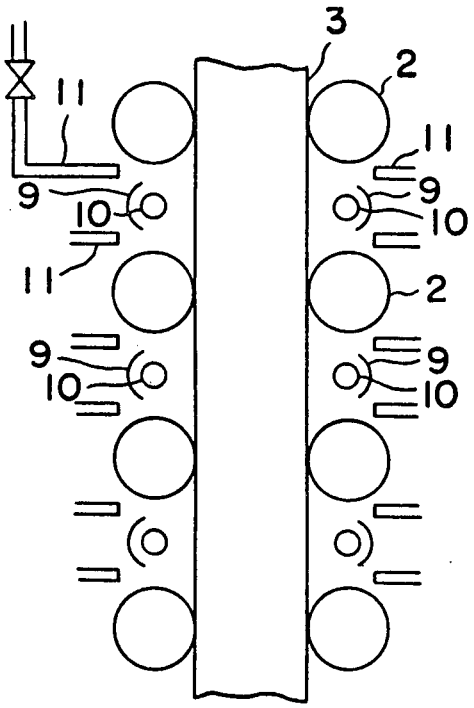
FIG. 3 is a side view showing the arrangement of foreign matter receiving gutters and foreign matter removing nozzles provided between rolls of the continuous casting system according to the invention.
Figure 4:
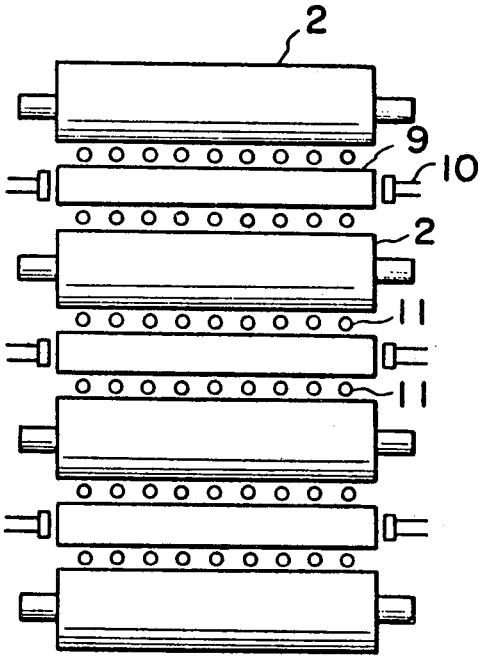
FIG. 4 is a plan view showing the arrangement of the gutters and the nozzles illustrated in FIG. 3.

As is shown in FIG. 3, a foreign matter receiving gutter 9 is disposed between two adjacaent rolls 2. The gutter 9 is made of a heat-resisting metal plate whose sectional view is like an arc. It is preferable that, as is illustrated in FIG. 4, the gutter 9 having substantially the same length as that of the roll 2, is arranged in parallel with the axis of the roll 2. Depending on the positions of the rolls 2, the gutters 9 may be placed only on one side of the rolls 2.

A foreign-matter-removing nozzle 10 is provided at each of two ends of the gutter 9 and in parallel with the same. The foreign matter removing nozzle 10 has a jet stream outlet which is directed to foreign matters dropped onto the gutter 9 to wash away the foreign matters. To these nozzles 10, a pressurized fluid supplying source (not shown) is connected, the pressurized fluid being pressurized water for instance. In FIGS. 3 and 4, two nozzles 10 are provided at two ends of the gutter 9, respectively as was described above. However, even if one of the two nozzles 10 is omitted, it is possible to wash away the foreign matters dropped on the gutter 9. A number of casting cooling nozzles 11 are arranged at two sides of the casting 2. The pressure of the pressurized water jetted out of the foreign matter removing nozzle 10 is 6–11 kg/cm$^2$, preferably 8 kg/cm$^2$.

Figure 5:
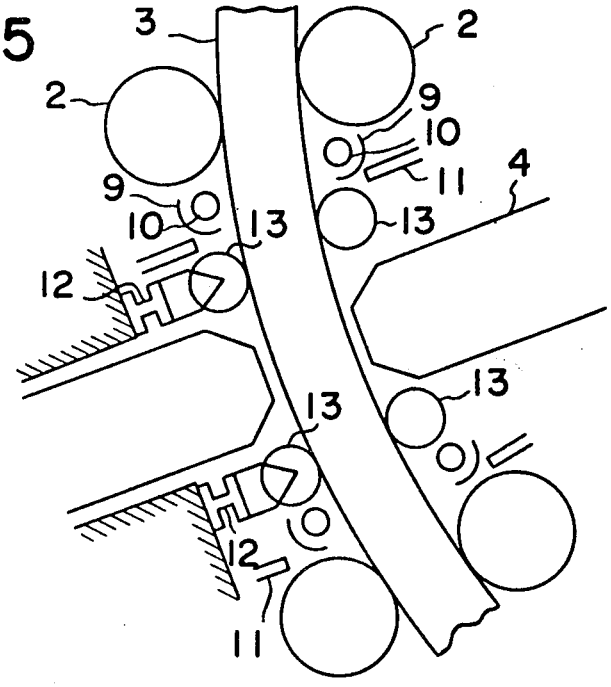
FIG. 5 is an enlarged view illustrating a part of FIG. 1, where an electromagnetic agitator is provided, in more detail.

A part of FIG. 1 including the electromagnetic agitator 4 is illustrated in FIG. 5 in more detail. The electromagnetic agitator 4 is provided at the curved portion of the passage of castings which portion is 3–8 meters away from the mold 1 in the direction of drawing castings, and small rolls 13 are provided at the upperstream and downstream sides of the electromagnetic agitator 4. The small roller 13 has a diameter smaller than the firstly-mentioned roller 2, and is supported by a segment frame 12 made of an T-shape steel member.

At two sides or one side of the casting and between the two rolls 2 and 13, there are provided foreign matter receiving gutters 9 made of non-magnetic material such as stainless steel plate whose section is like an arc, and the above-described foreign matter removing nozzle 10 having its jet stream outlet directed to foreign matters (such as asbestos, scales, and other waste materials produced when a casting is cooled) dropped into the gutter 9.

The gutter 9 may be so modified that it fully covers the space between the two rolls 2 and 13 and the jet stream outlets of the casting cooling nozzles 11 appear at respective suitable points of the gutter 9. The nozzle 11 and the gutter 9 may be independently provided.

The magnetic poles of the electromagnetic agitator 4 tapered at their ends are set so close to the casting that the energy loss of the electromagnetic agitator is minimized.

The small rolls 13 are disposed on two sides of the electromagnetic agitator 4 in such a manner that the casting supporting distance is as short as possible. As a result, the occurrence of accidents or troubles due to slabs, bulging and internal cracks is prevented.

Thus, the removal of the foreign matters can be achieved. However magnetic substances such as scales or ground metals due to molten metal leakages may still approach the electromagnetic agitator 4. In this case, the proximity switch 7 provided at the inlet side of the agitator 4 detects the magnetic substance approaching the agitator 4, and the command signal generator 6 connected to the proximity switch 7 supplys a command signal to the power supply controlling device 5 so that the device 5 operates to deenergize the electromagnetic agitator 4 and thereby to prevent the troubles due to the vibration of the magnetic substance. If, when a period of time defined by te following equation has passed after the magnetic substance had moved out of the sensing range of the proximity switch 7, both of the proximity switch 7 and the proximity switch 8 provided at the outlet side of the agitator sense no magnetic substance, the command signal generator 6 delivers a command signal to the power supply controlling device 5 to energize or operate the agitator again.

$$t = L/V$$

Where $L$ is the distance (m) between the proximity switches 7 and 8, $v$ is the drawing speed (m/sec) of a casting or a magnetic substance, and $t$ is the period of time required for the magnetic substance to move from the proximity switch 7 to the proximity switch 8.

The proximity switches 7 and operate in the same way as described above when a dummy bar passes through these switches in the pouring start period, and also when reduction of the drawing speed of a casting causes its surface temperature to be lower than the Curie temperature as a result of which a part of the casting is made magnetic. Thus, according to this invention, the troubles due to the vibration of a dummy bar or a casting can also be prevented.

Minute magnetic substances in a casting can be detected by the use of proximity switches whose loop coils surround the casting, or by the provision of more proximity switches along the passage of castings.

Figure 2:
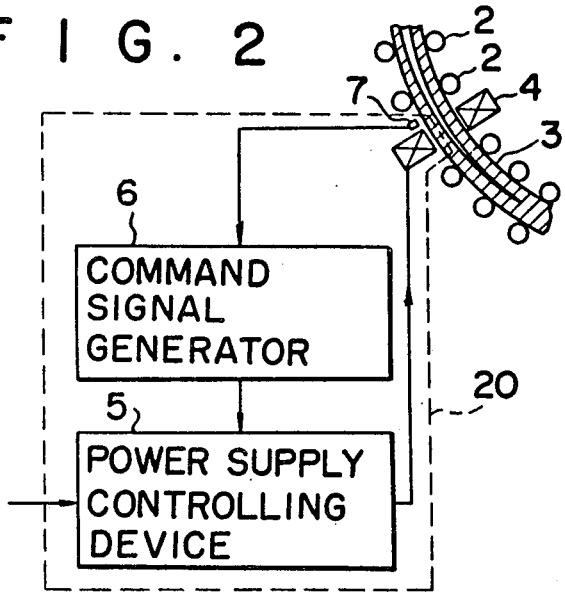
FIG. 2 is also an explanatory diagram, partly as a block diagram, illustrating a modification of the embodiment shown in FIG. 1.

In the system of the type, described above, a dummy bar is used only when the pouring process starts. In this case, the energization and deenergization of the electromagnetic agitator can be suitably controlled by an operator observing the movement of the dummy bar. Therefore, if it is intended to prevent the troubles which may be caused in the above-described cases (2) and (3), or in the period other than the pouring start period, the proximity switch 8 provided at the outlet side of the electromagnetic agitator 4 can be omitted as is shown in FIG. 2.

In this case, the command signal generator 6 is so designed that, when a period of time, that is (the length of the agitator 4)/(the drawing speed of a casting) seconds has passed after the proximity switch 7 operated to deenergize the agitator in response to a magnetic substance approaching thereto and the magnetic substance moved out of the sensing range of the proximity switch, the command signal generator produces a command signal to energize the agitator through the power supply controlling device again.

As is apparent from the above description, in the continuous casting system according to the invention, the foreign matters droping during the drawing operation of castings are received by the foreign matter receiving gutters provided between the rolls, and are removed by jet streams supplies through the foreign matter removing nozzles. Therefore, it is possible to prevent the rolls from being irregularly rotated or stopped at worst, and worn at one side only, that is, the rolls have a relatively long service life, according to this invention. In addition, it is no longer necessary for a person to remove the foreign matters accumulated under or between the rolls under the hazardous environmental conditions.

When a magnetic foreign matter still aproaches the electromagnetic agitator although foreign matters have been removed by the use of the foreign matter removing nozzles, the magnetic foreign matter is detected so as to deenergize the agitator thereby preventing troubles caused by the vibration of the foreign matter. This method is effective in the case when a dummy bar employed during the pouring start period passes through the electromagnetic agitator.

Thus, the continuous casting system according to this invention has various advantages over the conventional continuous casting system, and yet it has a relatively simple construction and is economical. The components such as the foreign matter receiving gutters, the foreign matter removing nozzles, the proximity switches, the command signal generator, and power supply controlling device of the present invention can be readily mounted on the conventional continuous casting systems.

What is claimed is:

1. A continuous casting system having an electromagnetic agitator, which comprises:

electromagnetic agitator control means operable to control operation of said electromagnetic agitator when a magnetic substance approaches same, and including first detecting means provided on the inlet side of said electromagnetic agitator for deenergizing said agitator upon detection of a magnetic substance approaching said agitator, and second detecting means provided on the outlet side of said electromagnetic agitator for energizing said agitator after both detecting means cease to detect the magnetic substance.

2. A continuous casting system according to claim 1, in which said magnetic substance is a dummy bar.

3. A continuous casting system as claimed in claim 1 in which said electromagnetic agitator control means further comprises:

a command signal generating means for generating a first command signal when said first detecting means detect a magnetic substance approaching said electromagnetic agitator, and thereafter a second command signal when both of said first and second detecting means do not detect said magnetic substance; and a power supply controlling means for deenergizing said electromagnetic agitator by receiving said first command signal from said command signal generator and for energizing again said electromagnetic agitator by receiving said second command signal.

4. A continuous casting system as claimed in claim 1 in which said first and second detecting means are proximity switches.

* * * * *